US010782112B2

(12) United States Patent
Du et al.

(10) Patent No.: US 10,782,112 B2
(45) Date of Patent: Sep. 22, 2020

(54) AMMUNITION FIRING AUTHORIZATION SYSTEM

(71) Applicants: Rebecca Reixin Du, San Ramon, CA (US); Xiaosong Du, San Ramon, CA (US)

(72) Inventors: Rebecca Reixin Du, San Ramon, CA (US); Xiaosong Du, San Ramon, CA (US)

( * ) Notice: Subject to any disclaimer, the term of this patent is extended or adjusted under 35 U.S.C. 154(b) by 0 days.

(21) Appl. No.: 16/414,039

(22) Filed: May 16, 2019

(65) Prior Publication Data

US 2019/0293397 A1 Sep. 26, 2019

Related U.S. Application Data

(62) Division of application No. 15/949,204, filed on Apr. 10, 2018, now abandoned.

(60) Provisional application No. 62/485,063, filed on Apr. 13, 2017.

(51) Int. Cl.
*F42C 15/40* (2006.01)
*F41A 17/08* (2006.01)

(52) U.S. Cl.
CPC ..... *F42C 15/40* (2013.01); *F41A 17/08* (2013.01)

(58) Field of Classification Search
CPC ..... F42C 15/40; F42C 15/42; F42C 19/10; F42C 19/04
USPC ..... 102/202.1–202.5, 202.7–202.9, 202.11, 102/202.12, 202.14, 215
See application file for complete search history.

(56) References Cited

U.S. PATENT DOCUMENTS

| | | | | | |
|---|---|---|---|---|---|
| 5,272,828 | A * | 12/1993 | Petrick | F41A 9/61 | 42/50 |
| 5,303,495 | A * | 4/1994 | Harthcock | F41A 9/62 | 42/1.02 |
| 5,698,816 | A * | 12/1997 | Roxby | F42B 5/025 | 102/439 |
| 6,283,034 | B1 * | 9/2001 | Miles, Jr. | F42B 5/08 | 102/202.5 |
| 6,760,992 | B2 * | 7/2004 | Brosow | F41A 17/063 | 42/70.04 |
| 7,533,614 | B1 * | 5/2009 | Reich | F42B 5/025 | 102/430 |
| 7,958,662 | B2 * | 6/2011 | Mossberg | F41A 17/00 | 42/70.01 |
| 8,984,999 | B2 * | 3/2015 | Frick | F42C 11/008 | 89/6.5 |
| 9,766,051 | B1 * | 9/2017 | Palo | F42C 15/42 | |
| 2006/0117632 | A1 * | 6/2006 | Meyerle | F42B 5/08 | 42/70.01 |
| 2014/0083318 | A1 * | 3/2014 | Templ | F41A 17/063 | 102/215 |
| 2017/0160065 | A1 * | 6/2017 | Nath | F42C 19/0823 | |
| 2018/0299220 | A1 * | 10/2018 | Du | F42C 15/40 | |

* cited by examiner

*Primary Examiner* — John Cooper
(74) *Attorney, Agent, or Firm* — Howard H. Sheerin

(57) ABSTRACT

An apparatus is disclosed comprising a projectile and a propellant configured to propel the projectile. The projectile comprises an antenna configured to receive an authorization signal, wherein control circuitry is configured to enable the propellant to propel the projectile in response to an authorization signal. At least part of the control circuitry may be integrated into the projectile, wherein the control circuitry may comprise a wireless receiver configured to receive the authorization signal from the antenna.

13 Claims, 7 Drawing Sheets

AMMUNITION FIRING AUTHORIZATION SYSTEM

CROSS REFERENCE TO RELATED APPLICATIONS

This application is a divisional of U.S. patent application Ser. No. 15/949,204, filed on Apr. 10, 2018, which claims priority to U.S. Provisional Patent Application Ser. No. 62/485,063, filed on Apr. 13, 2017, which is hereby incorporated by reference in its entirety.

BACKGROUND

As of today, gun violence is a global issue without a good solution. Traditional gun violence mainly occurred in gang fighting or drug related crime. Most of the victims are gang members or drug dealers. The number of deadly victims per case is generally small. However, the situation had changed dramatically in recent years. Many gun violence cases target masses of innocent people; some of them even target young children or senior citizens. Meanwhile, the number of deadly victims per case has increased sharply. In the 2016 Florida gay club shooting, nearly 50 people died, plus another 50 people injured. The background of gunners varies from the mentally ill, to young students to terrorists. Many of them don't have any criminal or mental illness records and acquire the gun and ammunition legally. Although laws and regulations for strict gun control have been discussed for decades, little progress was made. Even though the new laws or regulations will be passed, considering the fact that there are over 300 million guns in the United States, enforcing the law is still a big challenge. It is time to address this problem from another angle, which is to control the ammunition. The presented patent presents a "smart ammunition" and its associated method, apparatus and system that requires a set of authorization procedures before the ammunition can be successfully fired. Without this procedure, the ammunition cannot be fired even it is loaded, for example, into a gun and the trigger is pulled.

DETAILED DESCRIPTION

Figure 1:
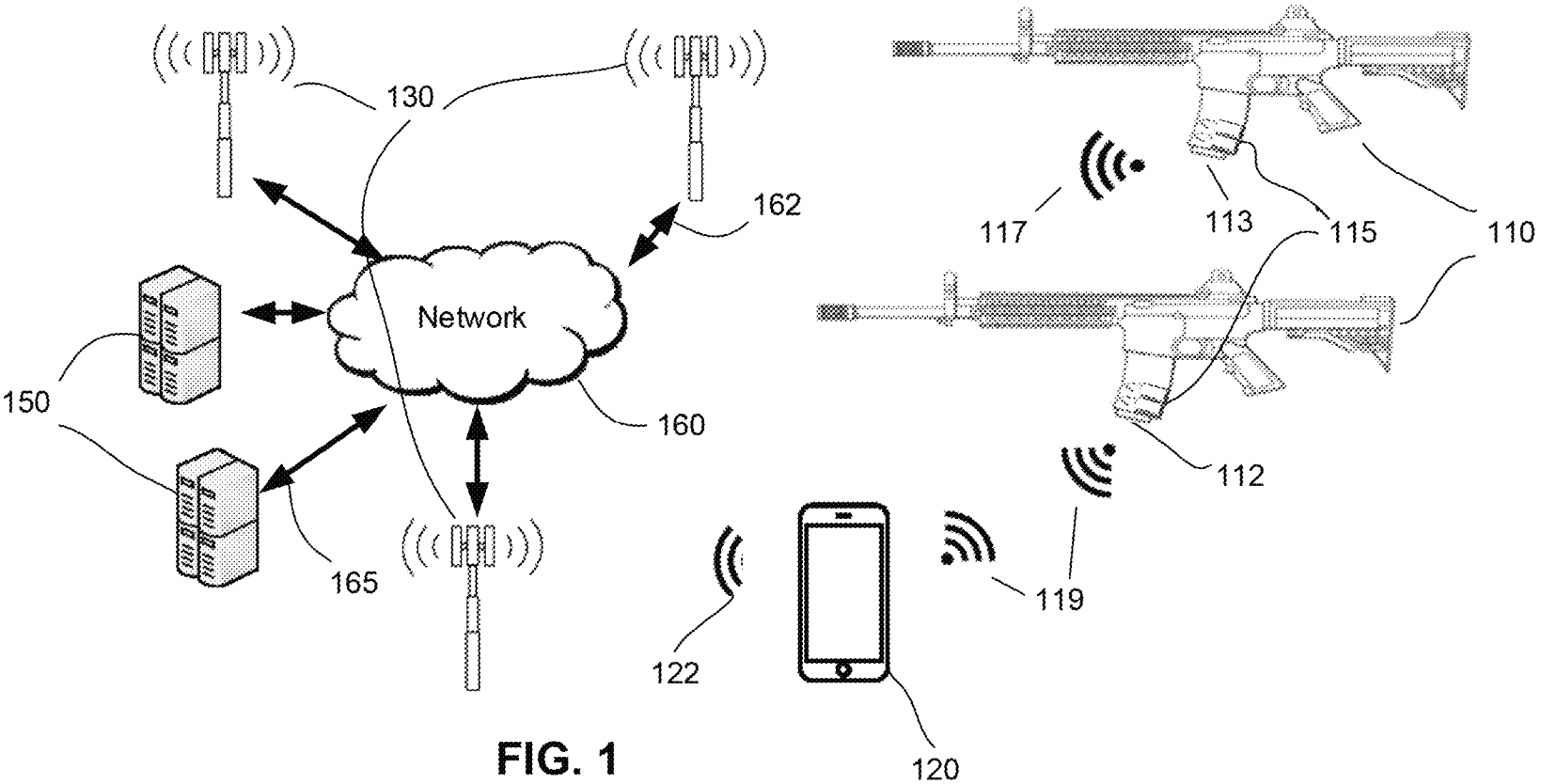
FIG. 1 shows an embodiment wherein a smart ammunition is fired by a gun.

FIG. 1 is a block diagram of an embodiment comprising generic guns (110), smart ammunition (115), local authorization servers (112, 113), optional smart device (120), local wireless network (119), authorization wireless network (117, 122), wireless antenna and wireless base stations (130), Internet (160, 165) and authorization server clusters (150). In one embodiment, without proper authorization, the propellant of the smart ammunition (115) will not ignite.

In one embodiment, the smart ammunition (115) has a wireless antenna and a wireless transceiver in it. Upon receiving wireless signals from the local authorization servers (112, 113), the smart ammunition (115) will periodically send out authorization requests to the local authorization servers (112, 113) with its unique identification number. Upon receiving the authorization requests from the smart ammunition (115), the local authorization servers (112, 113) will relay the requests through wireless network (117) to wireless base stations (130), then through Internet (160, 165) to authorization clusters.

In another embodiment, the local authorization server (112) communicates with a smart phone or other smart device (120) through local wireless network such as WiFi, Bluetooth, etc. The smart phone or other smart device (120) relays the request through wireless network (117) to wireless base stations (130), then through Internet (160, 165) to authorization clusters. The geographical location information is added during the authorization request rely process. This information can be added at multiple points. For example, if the local authorization servers (112, 113) have the optional GPS modules, they can add the geographical location information. If the smart phone or other smart device (120) has GPS module, it can add the geographical location information. The wireless base stations (130) can triangulate the requests and determine the rough location and add this information to the requests and send to the authorization server clusters (150). The authorization clusters (150) receive the authorization requests plus the associated geographical location information, evaluate the risk of the requests and decide if authorize the requests or deny the requests. The decisions are sent back through the same path to the smart ammunition (115). If the authorization requests are granted, the smart ammunition (115) will be armed. Upon the gun trigger is pulled, the firing pin hits the smart ammunition (115); its propellant will ignite (e.g., gun powder) inside the ammunition cartridge and drive the projectile (e.g., out a gun barrel). If the authorization requests are denied, the smart ammunition (115) will be disarmed; which means when the firing pin hits the smart ammunition (115), its propellant will not ignite.

In one embodiment, the risk evaluation process at the authorization server clusters (150) is a dynamic, multi-factor decision making process. For example, it will check if the geographical location of the request is too close to public school, transportation center, or other big public gathering. If so, the request will be denied. Local government, school or other organization can register with the authorization server clusters (150) and mark certain area during certain time period as public safety high risk zoom which the authorization server clusters (150) will deny any smart ammunition (115) authorization requests close to the zoom during the given period of time. After the event is over, the authorization requests at the given area can be granted. The authorization server clusters (150) can not only deny the authorization requests from the high risk zone, but also inform the law enforcement at the high risk zone regarding the requests so that proper actions can be taken to protect the public safety.

Figure 2:
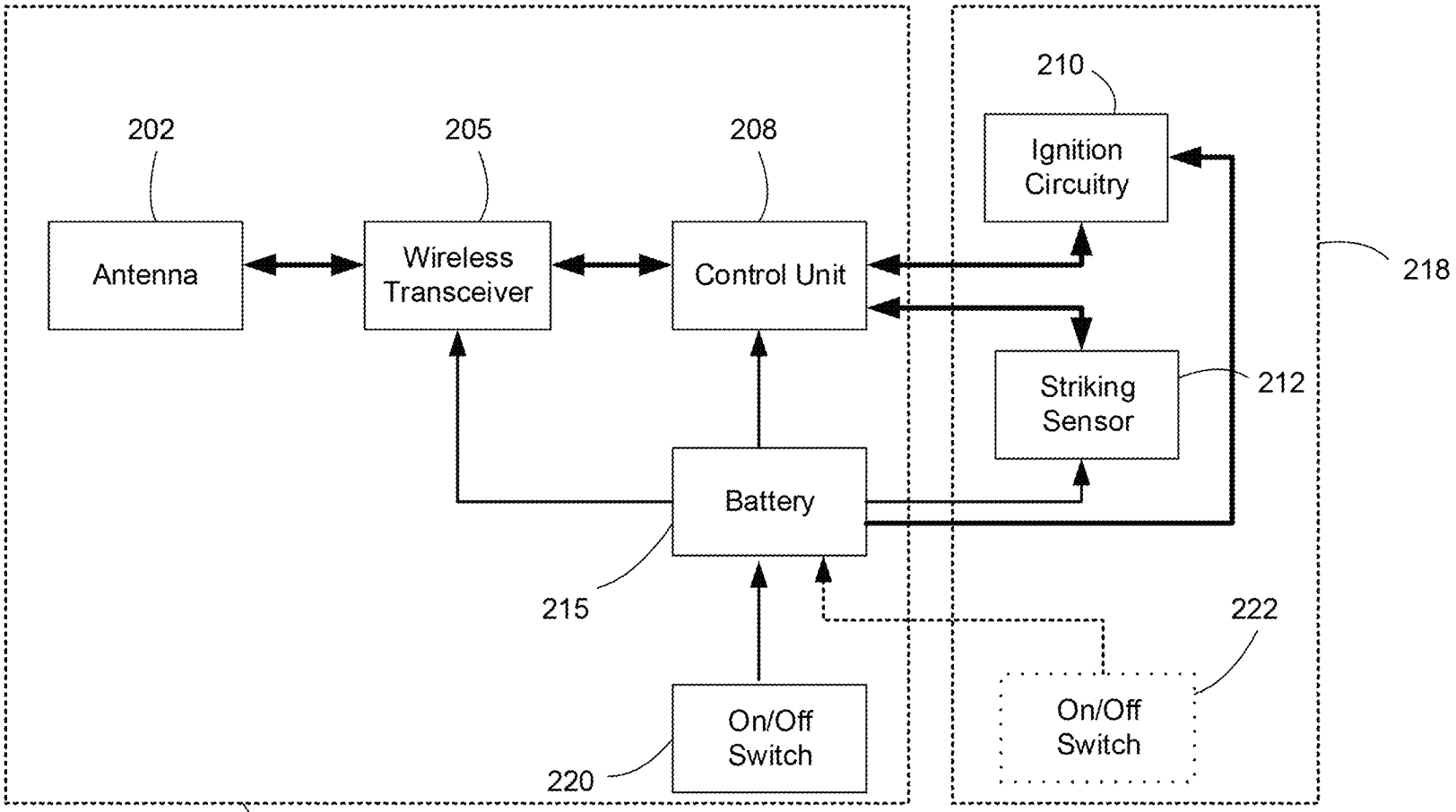
FIG. 2 shows a smart ammunition according to an embodiment.

FIG. 2 is a block diagram of a smart ammunition according to an embodiment. It illustrates one possible embodiment of the smart ammunition using all active components. Unlike a traditional ammunition, the smart ammunition has a set of circuitry and mechanical mechanism to enable the firing authorization process and ensure the firing authorization grant or denial being executed cannot be comprised. In this embodiment, there is a small turn on/off (220, 222). One possible implementation is a small screw shape on/off switch illustrated in FIG. 4 (409, 425). They can be located at the projectile (220, 409), or located near the bottom of the cartridge (222, 425). In one embodiment, using a small screw driver to twist the small switch can turn on/off the smart ammunition. If the on/off switch of the smart ammunition is off, it cannot be fired. Upon turning on the smart ammunition, a battery (215) within the smart ammunition will power up all the active functional blocks of the smart ammunition, which include wireless transceiver (205), control unit (208), ignition circuitry (210), and striking sensor (212).

After control unit (208) initialization, in one embodiment it will periodically send an authorization request with its unique identification number through the wireless transceiver (205) and the wireless antenna (202) to the local authorization server (113, 112). The reason of periodically authorization is to make sure that authorization is only valid for a small amount of time, usually couple of minutes. To do so, we can limit or eliminate the risk of the smart ammunition authorized in a safe zone and later used in a risk zone. Upon receiving authorization grant reply from the local authorization server (113, 112), the control unit (208) will enable the striking sensor (212) unit. When the trigger of the gun is pulled, the striking pin hits the smart ammunition. The striking sensor (212) senses the striking; it will inform the control unit (208). The control unit (208) will enable the ignition circuitry (210) to ignite the propellant of the smart ammunition. If the control unit (208) of the smart ammunition receives the denial response, it will not enable the striking sensor (212) and the ignition circuitry (210) so that the propellant cannot ignite even when the striking pin of the gun hits the smart ammunition.

In one embodiment, the smart ammunition can permanently disable its firing capability upon receiving certain level of denial response from the authorization server. For example, trying to authorize a smart ammunition near public school or public transportation, the denial response may have the highest priority. It can cause the smart ammunition permanently disable its firing capability. At the authorization server clusters (150) side, these types of requests will be recorded and reported to public safety authority for further actions.

In one embodiment, many of the major parts (201) of the smart ammunition are installed inside the projectile, while a few of the smaller parts (218) may be installed inside the cartridge. In one embodiment, there may be a small set of thin wires connecting the projectile components with the components inside the cartridge. Upon propellant igniting, the high temperature may melt the thin wires and break the connection between projectile and the cartridge.

Figure 3:
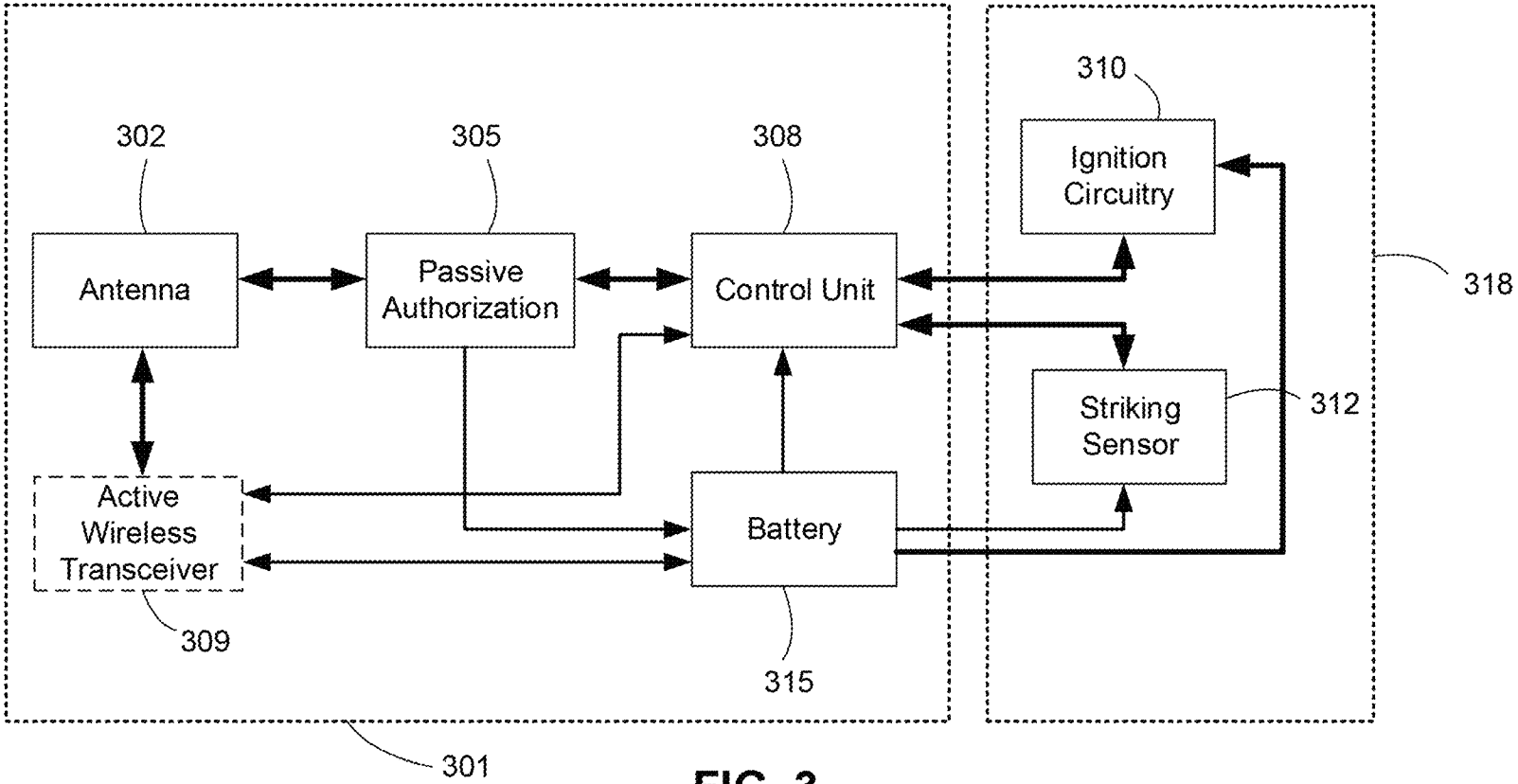
FIG. 3 illustrates an embodiment wherein the smart ammunition may be activated to fire using a passive authorization.

FIG. 3 illustrates a block diagram of the smart ammunition using passive authentication according to an embodiment. In this embodiment, an antenna (302) connects to a passive authorization unit (305). The antenna (302) collects the wireless energy sent by the local authorization servers (112, 113), and uses this energy to charge the passive authorization unit (305). After charging up, the passive authorization unit (305) will communicate with the local authorization servers (112, 113) to send out authorization request with its unique identification number. If the request is rejected, it will do nothing. If the request is granted, it will send out signal to turn on a battery (315) of the smart ammunition and wake up a control unit (308), a striking sensor (312), an ignition circuitry (310) and optionally an active wireless transceiver (309). The control unit (308) will enable the striking sensor (312) unit. When the trigger of the weapon is pulled, the striking pin hits the smart ammunition. The striking sensor (312) senses the striking; it will inform the control unit (308). The control unit (308) will enable the ignition circuitry (310) to ignite the propellant inside the smart ammunition. The propellant will drive the projectile out of the weapon.

In one embodiment, the grant from the passive authorization unit (305) only works for a short period of time. During this period of time, if the trigger is pulled, the smart ammunition will fire. After this period of time, the battery unit (315) is turned off. The local authorization servers (112, 113) have to charge it and authorize it again. It can prevent the smart ammunition being authorized at safe zone and be used at dangerous zone. If the optional active wireless transceiver (309) unit is presented, the control unit (308) can use it to send out authorization request to the local authorization servers (112, 113) when the grant period is passed instead of shut off the whole smart ammunition. If the new request is granted, the smart ammunition continues to be active; otherwise, it will shut off.

Figure 4A:
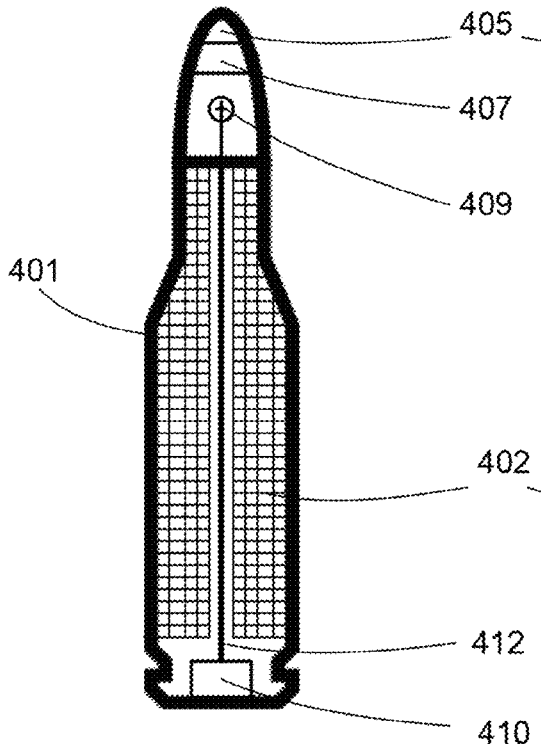
FIGS. 4A and 4B show a smart ammunition according to embodiments comprising a cartridge, a propellant, and a projectile.
Figure 4B:
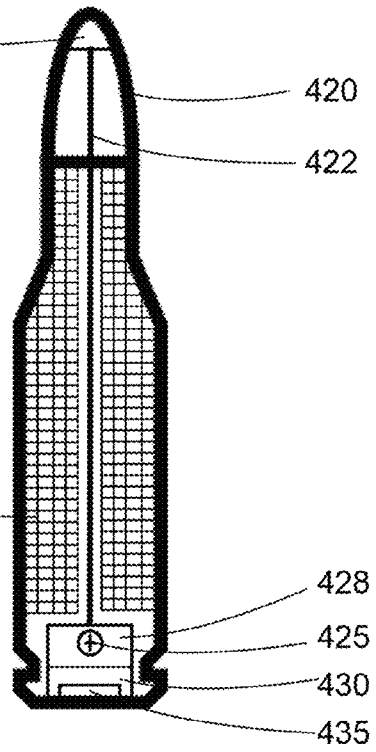

FIGS. 4A and 4B illustrate two possible embodiments of the smart ammunition. In both embodiments, an antenna is installed within the projectile (405) of the smart ammunition. In the embodiment (401) of FIG. 4A, a wireless transceiver, a control unit, an on/off switch, and a battery are installed within the projectile (407,409) of the smart ammunition. A set of thin wires (412) connect to the bottom of the cartridge, where a striking sensor and ignition circuitry (410) are installed. Inside the cartridge is a propellant (402).

In the embodiment (420) of FIG. 4B, an antenna is installed within the projectile (405) of the smart ammunition. A set of thin wires (422) connect the antenna with a wireless transceiver, control unit and a battery (428). An on/off switch (425), ignition circuitry (430), and a striking sensor (435) are installed at the bottom of the cartridge. In a passive embodiment such as shown in the embodiment (401) of FIG. 4A, the smart ammunition comprises a passive antenna, passive authorization unit, control unit, battery and optional active wireless transceiver (407) all installed within the projectile (405). A thin set of wires (412) connect to the ignition circuitry and the striking sensor at the bottom of the cartridge (410). In an alternative passive embodiment such as shown in the embodiment (420) of FIG. 4B, a passive antenna and passive authorization unit are installed within the projectile (405). A control unit, battery and optional active wireless transceiver (428) are installed at the bottom of the cartridge. A set of thin wires (422) connect them together. The ignition circuitry (430) and the striking sensor (435) are installed at the bottom of the cartridge. There is no on/off switch (425) in the passive embodiments.

Figure 5:
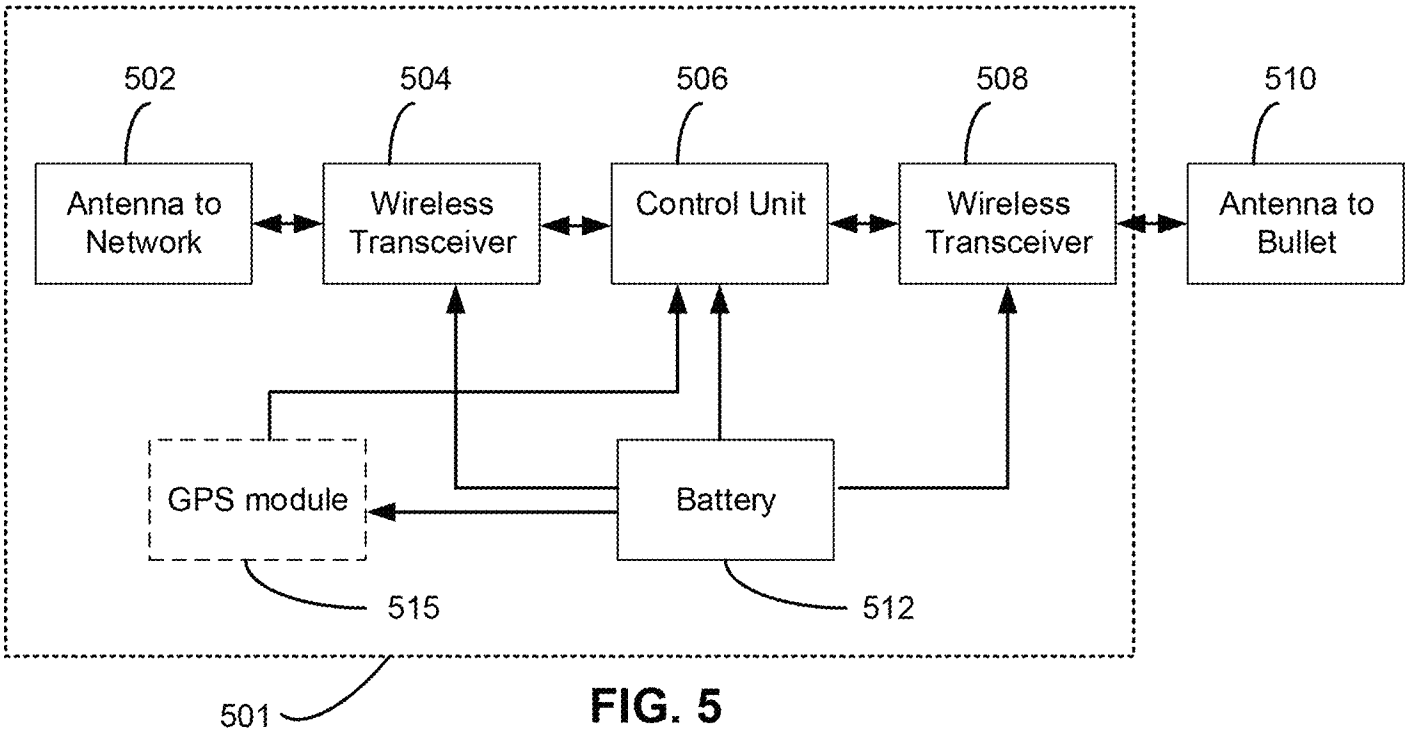
FIG. 5 shows an embodiment comprising a local authorization server.

FIG. 5 shows a block diagram of an embodiment of a local authorization server (501). This local authorization server (501) can be integrated into a smart ammunition or attached to the outside of the smart ammunition. It has a first antenna (510) which is used to communicate with the smart ammunition. It has a second antenna (502) which connects to the wireless network or a smart phone, and the smart phone further connects to the wireless network. In this embodiment, there are two wireless transceivers inside the local authorization server (501). One is used to communicate with the authorization server clusters (504). One is used to communicate with the smart ammunitions (508). A control unit (506) is used to control the communication between the authorization server cluster and the smart ammunitions. An optional GPS module can be installed and connected to the control unit so that the geographical location information can be added when the smart ammunitions are requested for authorization. A battery unit (512) is used to power up the local authorization server (501).

Figures 6A, 6B:
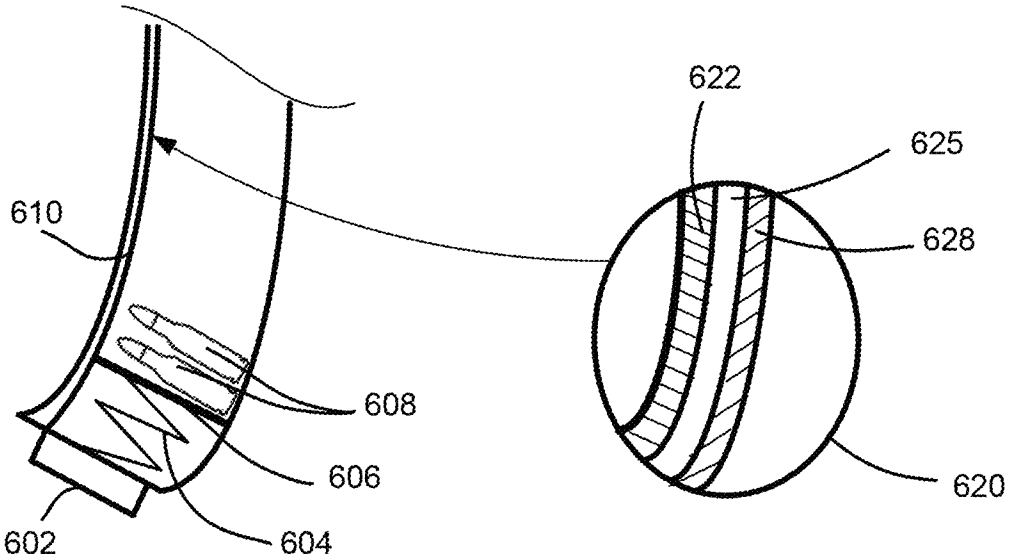
FIGS. 6A and 6B show an embodiment of a weapon magazine configured to store a plurality of the smart ammunition.

FIG. 6A shows an embodiment of a weapon magazine (610). The smart ammunitions (608) can be stacked into the weapon magazine as may be done conventionally. In this embodiment, the weapon magazine comprises a spring (604) and metal cap (606). A local authorization server (602) may be installed at the bottom of the weapon magazine. An antenna which communicates with the smart ammunitions of the local authorization server may be installed at the side of weapon magazine. Shown in (620) of FIG. 6B is a magnified view of the side of the weapon magazine. Inside of the outer metal casing (622) of the weapon magazine, an antenna (625) of the local smart server (602) is installed. The antenna (625) is isolated by non-metal layer (628) so that the smart ammunition antenna does not directly connect to the antenna of local authorization server so that the wireless communication can come through.

Figure 7C:
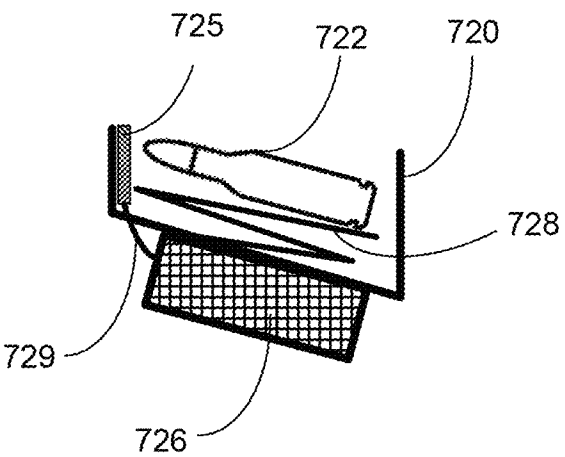
FIGS. 7A-7C show an embodiment of a weapon magazine comprising a wireless antenna and control circuitry configured to transmit an authorization over the wireless antenna to at least one of the smart ammunition to enable firing the smart ammunition.
Figure 7B:
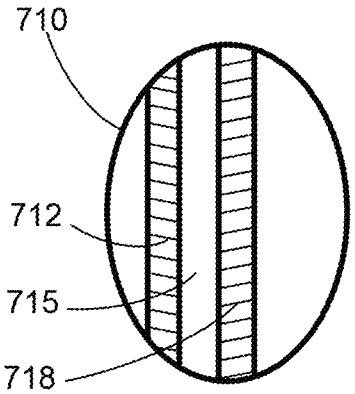
Figure 7A:
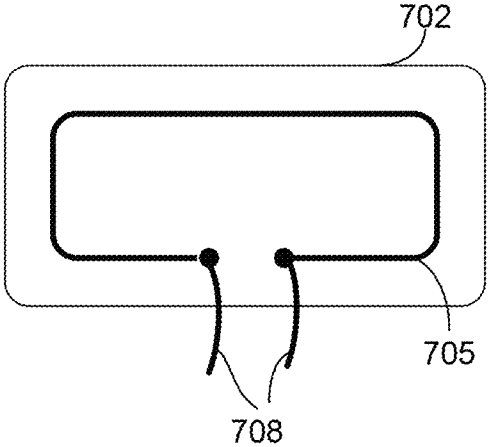

FIGS. 7A-7C illustrate how to convert a conventional gun with a weapon magazine (720) that is integrated with the gun. Referring to FIG. 7A, in this embodiment a thin flexible antenna patch (702) is employed. It has the antenna loop (705) and two wires (708, 729) which will connect to the local authorization server (726). Referring to FIG. 7B, shown in (710) is a magnified view of the side of the antenna patch (702). In this embodiment, one side is the sticky non-conductive glue (712) which can be stick onto the inside wall of the weapon magazine (720). In the middle, it is the antenna (715, 705) layer. The outer layer is a non-conductive layer to isolate the antenna (715, 705) from the projectile of the smart ammunition so that the wireless communication can be conducted. Referring to FIG. 7C, in this embodiment a thin flexible antenna patch (725) is attached at the internal of the weapon magazine, and connects (729) to the local authorization sever (726) which is attached to the outside of the weapon magazine (720). The smart ammunition (722) can be stacked into the weapon magazine (720). A conventional spring (728) of the weapon magazine is used to push the smart ammunition into the weapon one by one.

What is claimed is:

1. An apparatus comprising:

a projectile; and a propellant configured to propel the projectile, wherein the projectile comprises control circuitry configured to enable the propellant to propel the projectile in response to an authorization signal.

2. The apparatus as recited in claim 1, wherein the propellant is gun powder.

3. The apparatus as recited in claim 1, wherein the projectile is a bullet.

4. The apparatus as recited in claim 1, wherein the control circuitry comprises an antenna.

5. The apparatus as recited in claim 4, wherein the control circuitry comprises a wireless receiver configured to receive the authorization signal from the antenna.

6. The apparatus as recited in claim 1, further comprising a cartridge comprising the propellant and ignition circuitry configured to ignite the propellant.

7. The apparatus as recited in claim 6, further comprising a wire connecting the control circuitry to the ignition circuitry.

8. An apparatus comprising:

a projectile comprising an antenna configured to receive an authorization signal;

a propellant configured to propel the projectile; and control circuitry configured to enable the propellant to propel the projectile in response to the authorization signal.

9. The apparatus as recited in claim 8, wherein the projectile comprises the control circuitry.

10. The apparatus as recited in claim 9, wherein the control circuitry comprises a wireless receiver configured to receive the authorization signal from the antenna.

11. The apparatus as recited in claim 8, further comprising a cartridge comprising the propellant and the control circuitry.

12. The apparatus as recited in claim 11, further comprising a wire connecting the antenna to the control circuitry.

13. The apparatus as recited in claim 11, wherein the control circuitry comprises a wireless receiver configured to receive the authorization signal from the antenna.

* * * * *